US005584931A

United States Patent [19]

Buhlmann

[11] Patent Number: 5,584,931

[45] Date of Patent: Dec. 17, 1996

[54] ELECTROSTATIC SPRAY DEVICE

[75] Inventor: Eugen T. Buhlmann, Gossau, Switzerland

[73] Assignee: Gema Voltstatic AG, St. Gallen, Switzerland

[21] Appl. No.: 228,530

[22] Filed: Apr. 15, 1994

[30] Foreign Application Priority Data

Apr. 15, 1993 [DE] Germany ..... 43 12 262.0

[51] Int. Cl.[6] ..... B05B 5/025

[52] U.S. Cl. ..... 118/628; 118/300; 118/627; 118/629; 239/690.1; 239/706

[58] Field of Search ..... 118/620, 621, 118/627, 628, 629, 300; 239/690, 697, 698, 704–707, 690.1, 692

[56] References Cited

U.S. PATENT DOCUMENTS

| | | | |
|---|---|---|---|
| 3,630,441 | 12/1971 | Felici et al. | 239/3 |
| 4,228,961 | 10/1980 | Itoh | 239/698 |
| 4,921,172 | 5/1990 | Belmain et al. | 239/698 |
| 5,310,120 | 5/1994 | Ehinger et al. | 239/708 |
| 5,353,995 | 10/1994 | Chabert | 239/701 |
| 5,358,182 | 10/1994 | Cappeau et al. | 239/703 |

*Primary Examiner*—Jill Warden
*Assistant Examiner*—Jan M. Ludlow

[57] ABSTRACT

An electrostatic spray device contains a tube-like spray element (3); at least one charging electrode (12) to transfer electrostatic charges to the powder; at least one counterelectrode (44) arranged in the vicinity of the charging electrode (12), which is connected to an electrical potential (20) different from the charging electrode (12), so that it takes up at least part of the free ions generated during electrical charging of the powder; at least one ring-shaped element (44; 68; 74) which forms or carries the counterelectrode (44; 64; 74, 76) and extends around the downstream segment (72) of the spray element (3), on which it is radially supported; at least one connection ridge (78) outside the spray element (3), which carries the ring-shaped element (74) at its downstream end (79) and can be attached to the spray element (3) by its upstream end; and an electrical connection between the electrical potential connection (20) and the counterelectrode (44) by way of the connection ridge (78).

22 Claims, 3 Drawing Sheets

ELECTROSTATIC SPRAY DEVICE

FIELD OF THE INVENTION

The present invention relates to an electrostatic spray device and more particularly to an electrostatic spray device for powder coating material such as plastic powder or enamel powder.

BACKGROUND OF THE INVENTION

In the electrostatic spray coating of objects, powder is sprayed out of a spray opening of a spray device and given a positive or negative electrostatic charge, either immediately in front of this outlet opening or after this outlet opening. For this purpose, electrodes, referred to in the following as charging electrodes, are used, which are connected to an electrical high voltage in the range between 40 KV and 140 KV. The objects to be coated have a different electrical potential, preferably ground potential. The atomized powder particles move along electrical field lines which are generated by the high voltage between the charging electrode and the object to be coated. After a thin layer of powder has formed on the object to be coated, this layer repels subsequent powder particles because of its electrical charge that is, because both sets of powder particles are electrostatically charged in a like manner. As a result, only a limited layer thickness can be generated on the object to be coated. Furthermore, due to the reciprocal repulsion of the powder particles on the surface of the object to be coated, an unstable force ratio is created. This unstable force ratio has the result that the coated powder layer is not a smooth, flat coating surface that is formed, but rather a type of "hilly landscape," which forms a so-called "orange peel" when the layer is subsequently fired, and therefore should be prevented, if possible.

The electrostatic attraction characteristics of the object to be coated is different at the edges and corners as well as at openings of this object, as compared with large, flat large areas. Usually, corners and edges are coated less well or less thickly than adjacent larger surface areas. The powder particles fly around the edges of the outside circumference and around the edges of openings of the object to be coated, due to the effect of the electrostatic field, and are therefore drawn to the back of the object, because of its electrostatic attraction, so that the back of the object to be coated is also coated there. This can be called "electrical surrounding."

By using a counterelectrode which draws free ions out of the sprayed powder stream, the surface quality and the penetration capacity of the powder into depressions of the objects to be coated can be improved. Furthermore, a thicker powder layer can be applied to the objects to be coated, in a single spraying process, without an excessive amount of powder particles bouncing off the objects or being electrostatically repelled. In particular, an "orange peel"-like layer surface can be prevented.

OBJECT OF THE INVENTION

The present invention is supposed to accomplish the task of creating means by which one or more counterelectrodes can be inexpensively provided in spray devices, without requiring a lot of space, and in particular, by which commercially available spray devices can be subsequently provided in a retro-fitted manner, with at least one counterelectrodes. These means and the counterelectrode are not supposed to impair easy handling of the spray device.

BRIEF DESCRIPTION OF THE DRAWINGS

The invention is described in the detailed description following, with reference to preferred embodiments as examples, as well as to the accompanying drawings in which like reference characters designate like or corresponding parts throughout the several views, and wherein.

DETAILED DESCRIPTION OF THE PREFERRED EMBODIMENTS

Figure 1:
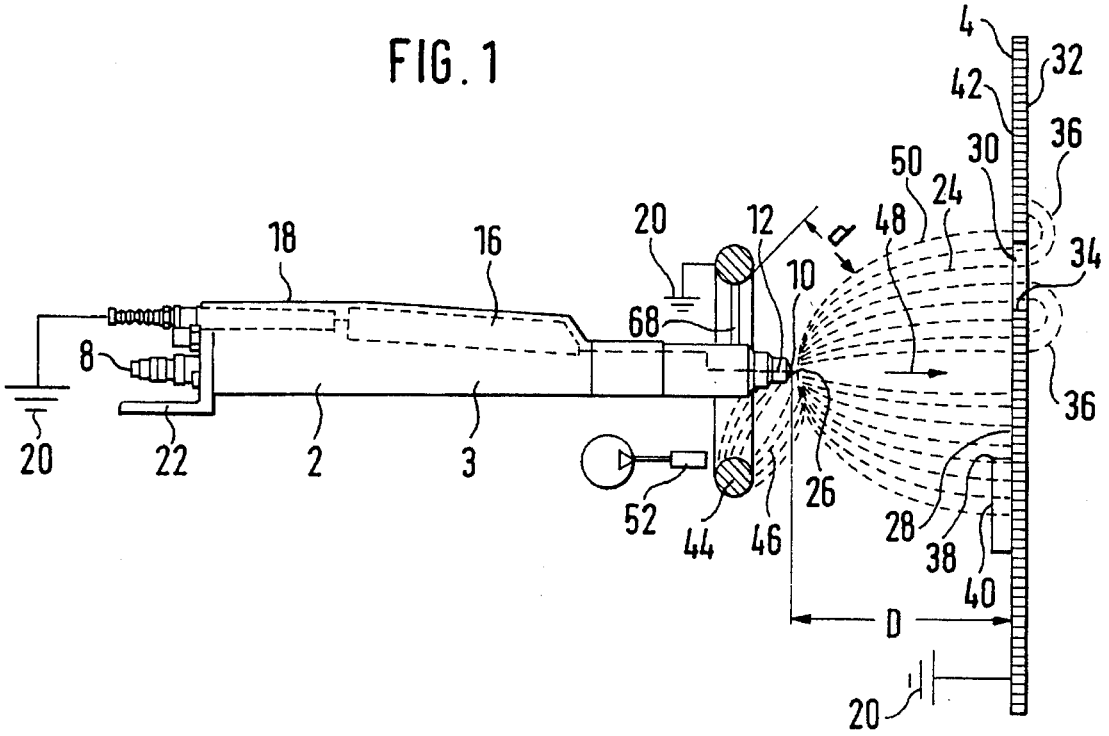
FIG. 1 is a schematic view of a spray device for electrostatic spray coating of objects, in which a counterelectrode is arranged in the form of a ring, coaxial to a charging electrode.
Figure 2:
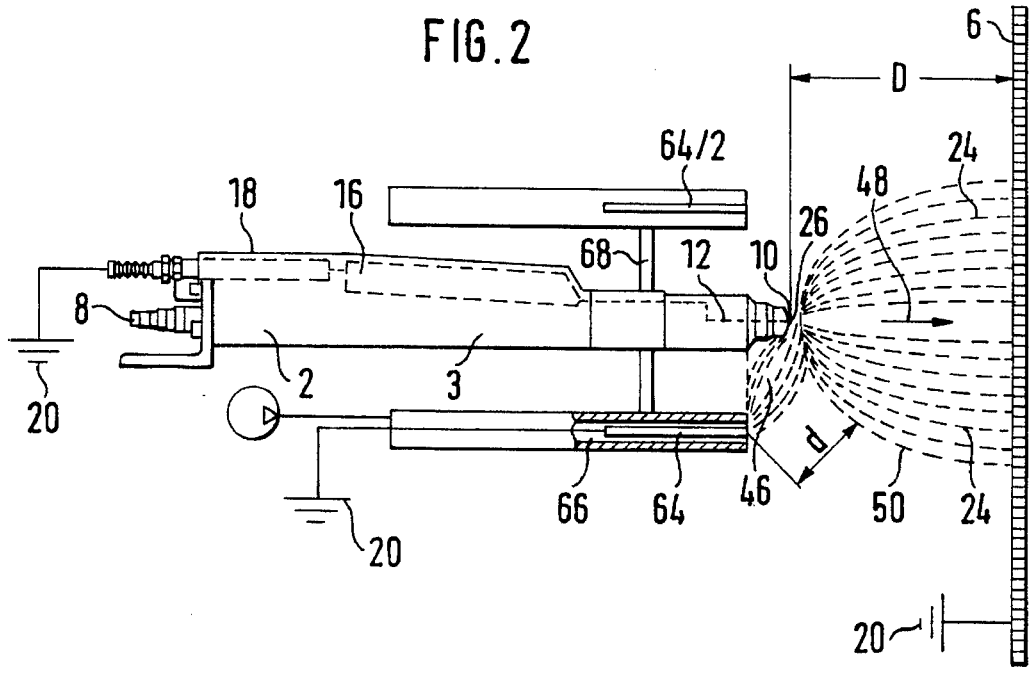
FIG. 2 is a schematic view of another embodiment of a spray device for electrostatic spray coating of objects, in which several rod-shaped wires are provided as the counterelectrode.

The spray device or spray gun 2 shown in FIGS. 1 and 2, for electrostatic spray coating of objects 4 and 6, each has a spray element 3 with an inlet 8 for pneumatically conveyed coating powder, an outlet 10 for the atomization or spraying of the powder onto the object 4 or 6, and at least one charging electrode 12 which lies axially in the powder stream. The charging electrode 12 is located in the outlet 10 or in the immediate vicinity upstream or downstream from the outlet 10, and is connected to a high-voltage generator 16, which generates an electrical output voltage in the range between 40 KV and 140 KV. The high-voltage generator 16 can be arranged within the housing 18 of the spray gun 2, as shown in the drawings, or externally to it. Both embodiments are known. Externally to the spray gun 2, the high-voltage generator 16 of FIG. 1 and 2 is connected to a direct current low-voltage source, not shown, and also to ground potential 20. Instead of an axial, needle-shaped charging electrode 12 in the outlet 10, several charging electrodes can be arranged in the core of the coating material stream or around it, within the housing 18 or in a nozzle which forms the outlet 10, at the downstream end of the housing 18. In practice, different charging electrodes and arrangements of charging electrodes are known. Furthermore, one or more charging electrodes can also be arranged outside the spray gun 2, in or near the stream of atomized powder. Such embodiments are also known.

The spray gun 2 shown is attached to a machine part or a robot 22 of a spray coating system. Instead, it can also have a handle and be used as a hand-held spray gun.

The object 4 or 6 to be coated is usually carried by a transport device, which is not shown, and transported through a spray coating cabin. The transport device is grounded, so that the object 4 or 6 which it carries is also grounded by the transport device.

The electrical high voltage generates electrical field lines 24, which run from the tip 26 of the charging electrode 12 to the object 4 or 6 to be coated. The powder particles sprayed out at the outlet 10 move along these field lines, towards the object 4 or 6 to be coated. In doing so, they also penetrate into depressions 28 of the object to be coated and through openings 30 of this object. In this way, the particles get into border regions of the object, and also onto its back or rear surface 32, because of the "electrical surrounding effect," as shown in FIG. 1 with the field lines 36 which "surround" the edge 34 of the opening 30. At projecting edges 38 or corners, a stronger layer thickness results, due to electrostatic interaction, than on raised surfaces 40 or larger flat surfaces 42 of the object 4 to be coated.

The sprayed powder has the form of a particle cloud, seen in longitudinal cross-section, as shown by the field lines 24 in FIGS. 1 and 2.

In FIG. 1, a ring-shaped counterelectrode 44, which has a different potential from the charging electrode 12 and serves to draw off free ions which are generated during electrostatic charging of the powder, is arranged coaxial to the charging electrode 12. In doing so, the counterelectrode 44 also attracts some electrons. This ion stream and its path from the charging electrode 12 to the counterelectrode 44 is designated with the reference number 46. The counterelectrode 44 can lie at a higher or lower electrical potential than the charging electrode 12. Preferably, the counterelectrode 44 is connected to ground potential 20. As shown in FIG. 1, the counterelectrode 44 is preferably arranged against the flow direction 48 of the powder, upstream from the tip 26 of the charging electrode 12 and coaxial to it, and thus outside of and upstream from the powder cloud that corresponds to the electrical field lines 24.

The outer surface 50 of the powder cloud, which corresponds to the electrical field lines 24 in terms of size and shape, is not a sharp cloud delineation, but rather a diffuse transition between an area of uniform particle distribution and the surrounding atmosphere. In the description given here, the term "outer surface 50" is understood to mean the area where the particles no longer fly towards the object 4 or 6 to be coated in a targeted manner, along field lines 24, but rather stray outside the field line area. The distance "d" between the counterelectrode 44 and the charging electrode 12, between the counterelectrode 44 and the tip 26 of the charging electrode 12, and between the counterelectrode 44 and the outer surface 50 of the powder cloud should be less than the distance "D" between the tip 26 of the charging electrode 12 and the object 4 or 6 to be coated. Preferably, the distance "d" between the tip 26 of the charging electrode 12 and the counterelectrode 44 is only one-third to one-half of the distance "D" between the tip 26 of the charging electrode 12 and the object 4 or 6 to be coated.

A compressed air nozzle arrangement 52 blows air over the counterelectrode 44 or into the interstice between the counterelectrode 44 and the charging electrode 12, in order to prevent the counterelectrode 44 from being coated with powder. Compressed air is only needed if coating of the counterelectrode 44 cannot be prevented in some other manner.

The counterelectrode 44 is preferably carried by the housing 18 of the spray gun 2.

Instead of one charging electrode 12 or one counterelectrode 44, several electrodes can also be present in each instance.

The embodiment of a spray gun 2 shown in FIG. 2 is identical with that of FIG. 1, except for the fact that in lieu of the ring-shaped counterelectrode 44, at least one counterelectrode 64 which is a needle-shaped wire electrode is used as shown in the embodiment of FIG. 2. Compressed air 66 flows around the electrode 64 coaxially, and thus the electrode 24 is kept clear of coating material. Preferably, several counterelectrodes 64 are arranged within an annular array which is coaxial to the charging electrode 12. These counterelectrodes 64 are preferably arranged around the charging electrode 12 at the same circumferential distance from one another. In FIG. 2, parts which correspond to parts in FIG. 1 are designated with the same reference numbers.

If desired, means 68 for axial and/or radial positioning of the counterelectrode 44 or 64 relative to the charging electrode 12 can be provided.

Methods of functioning of the embodiments according to FIG. 1 and 2 are as follows:

a) Without counterelectrode 44 or 64:

At the location of the at least one charging electrode 12, which can be an axial needle electrode according to FIGS. 1 and 2, or instead can be present in the form of a plurality of such or other electrodes, electrons are released under high electrical voltage conditions. In the vicinity of the high electrical field 24 of the charging electrode 12, a small part (approximately 1% to 5%) of the electrons is charged onto the coating material, which is powder in the present case. The rest flies to the nearest grounded location, for example approximately 80% onto the object 4 or 6 to be coated, approximately 10% onto the walls of the cabin, in which the objects are coated, and approximately 5% to 20% onto the downstream end of the spray gun, depending on the distance between the charging electrode 12 and the object 4 or 6 to be coated. The electrostatically charged powder finds its way onto the object 4 or 6 to be coated and for the most part adheres thereto. In doing so, the powder forms an electrically insulating layer on the object. The excess electrons, together with the powder on the surface of the object 4 or 6, exhibit a similar electrical charge and repel any powder particles which subsequently arrive. On the surface of the object 4 or 6, an electrostatically unstable force ratio is formed. This mechanism leaves a "hilly landscape" on the surface, and this is referred to as an "orange peel" after firing of the layer. The free ions in the air between the charging electrode 12 and the object 4 or 6 to be coated move at a very high speed of over 100 m/s. They follow the stronger electrostatic field in question, that is, the electrostatic forces. The electrostatically charged powder particles are subject to the kinematic flow forces, since they are transported in a gas stream or air stream. The movement speed of the powder particles is significantly less than that of the ions and is only approximately 10 to 15 m/s. This means that the ions move independently of the powder particles.

Each individual ion has its own electrostatic field. In the vicinity of an object, this field is very strong, due to the short distance from the grounded object. Therefore the Faraday effect is also correspondingly strong. The free ions, as a whole, form a high electrostatic spatial charge. As a whole, this spatial charge therefore acts as a strong Faraday cage at all corners and edges of the object to be coated, so that it prevents good penetration of the powder particles into depressions and grooves.

b) With counterelectrode or counterelectrodes 44 or 64:

When using a counterelectrode, the free ions are attracted by the counterelectrode 44 or 64 and are drawn out of the powder stream. The counterelectrode must be located in the vicinity of the charging electrode. The distance "d" between the charging electrode 12 and the counterelectrode 44 or 64 is preferably about one-third to one-half of the distance "D" between the charging electrode and the object 4 or 6 to be coated. If the distance "d" is greater, the counterelectrode loses its effect; the free electrons and ions are more strongly attracted by the object 4 or 6 to be coated than by the counterelectrode 44 or 64. If the distance "d" is less, there is an overly large electrical current that flows between the charging electrode and the counterelectrode, causing the electrical high voltage at the tip 26 of the charging electrode, and thus the field 24 which is necessary to charge the powder, to be reduced. The counterelectrode 44 or 64 causes an increased electrical current flow at the tip 26 of the charging electrode 12. This increased current flow causes the charging electrode 12 to generate significantly more free ions or electrons for electrostatic charging of the powder at the outlet 10 of the device 2, and these are then available for electrostatic charging. Furthermore, the degree of effectiveness of the application of the powder onto the object 4 or 6 to be coated is also significantly improved by the noted current flow. The counterelectrode 44 or 64 draws off the significant portion of the ions, approximately 60 to 80%. Only the charged powder particles, in other words only 2% to 8% of the entire electrical flow, still flow onto the object 4 or 6 to be coated. In other words, it is possible to separate the undesirable free ions from the powder stream. The ion spatial charge still exists here, but the stream of free ions is concentrated onto the counterelectrode 44 or 64. The Faraday effect is very strong at the counterelectrode, but only very slight at the object 4 or 6 to be coated. The electrostatically charged powder particles therefore penetrate better into depressions and grooves of the object 4 or 6. The "electrostatic surrounding" is also better. No accumulation of free ions occurs at the surface of the object 4 or 6. The electrostatic forces at the surface of the object 4 or 6 are significantly smaller. There is no unstable condition which prevails at the surface. The formation of an "orange peel" is inhibited. A significantly thicker powder layer can be applied to the object 4 or 6 in a single spraying process. Since there is the danger that the counterelectrode 44 or 64 will also be coated by the electrostatically charged powder, it is practical to flush the counterelectrode 44 or 64 with compressed air. To avoid coating of the counterelectrode 44 or 64, it is practical if it is arranged outside the powder stream, and in this connection, it is preferable if it is set back upstream with reference to the downstream tip 26 of the charging electrode 12, and not arranged between the charging electrode 12 and the object 4 or 6 to be coated.

The electrical current at the charging electrode is greater when using a counterelectrode 44 or 64. In experiments, the current increased from approximately 70 μA to approximately 100 μA. The powder cloud forms an electrical resistance and favors the ion flow to the counterelectrode 44 or 64.

Figure 3:
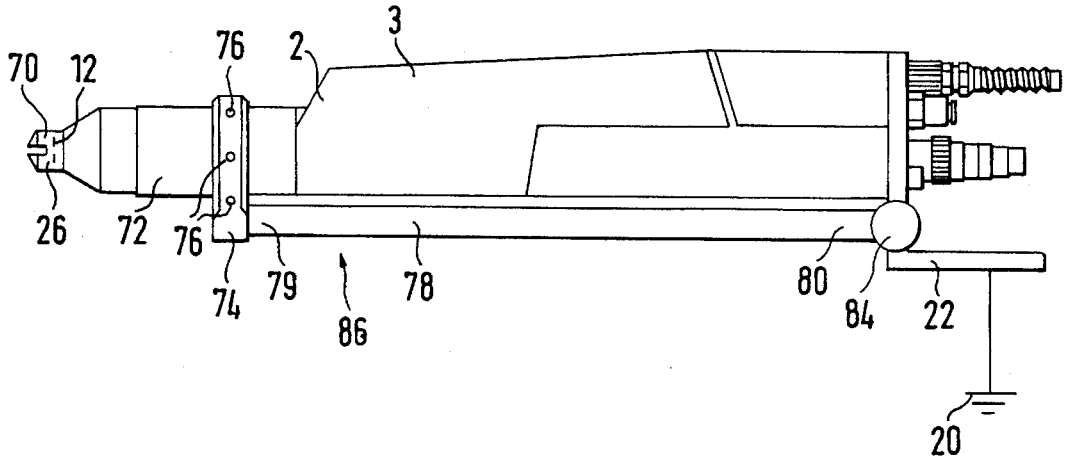
FIG. 3 is a side elevation view of another electrostatic spray device according to the invention.
Figure 4:
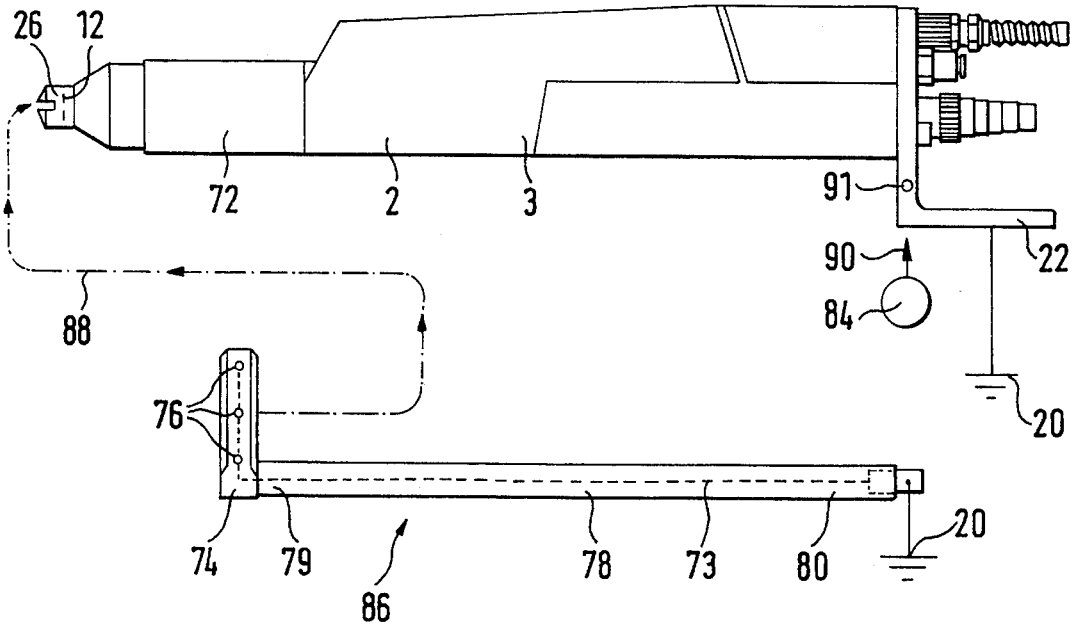
FIG. 4 is a side elevation view of the spray device of FIG. 3, with the counterelectrode device removed.

The electrostatic spray device 2 shown in FIGS. 3 and 4 essentially consists of a tube-like spray element 3, at the downstream end of which a slit nozzle 70 to atomize the pneumatically transported powder is attached. Within the spray nozzle 70 or the spray element 3, there is at least one charging electrode 12 for electrostatic charging of the powder. A ring-shaped element 74 is set onto the downstream segment 72 of the spray element 3, to which the spray nozzle 70 is attached, and this element forms a counterelectrode and/or carries several needle-like counterelectrodes 76, which project out of it. The counterelectrodes 74 and 76 are connected to an electrical potential, preferably a ground potential, which is different from the electrical potential of the charging electrode 12. The ring-shaped element 74 is attached to the downstream end of a connection ridge 78, which has an axis which is disposed parallel to the axis of to the spray element 3 and which is inserted into a holder 22 by means of its upstream end which 80 and fixedly positioned there by means of a screw with a knurled screw head 84.

FIG. 4 shows the spray device 2 of FIG. 3 with the counterelectrode device 86 removed, wherein narrows 88 show the movement direction for setting the ring-shaped element 74 into place on the downstream segment 72. Furthermore, an arrow 90 indicates the insertion direction for the screw 84 into a threaded bore 91 in the holder 22. FIG. 4 shows a ground potential connection 20. The ground potential connection 20 can be connected directly to the connection ridge 78, if it and the ring-shaped element 74 consist of electrically conductive material. If at least the connection ridge 78 consists of electrically insulating material, an electrical line 73 which connects the ground potential connection 20 with the counterelectrodes 76 is provided, wherein the line 73 extends through the connection ridge 78 and the ring-shaped element 74. The ring-shaped element 74 consists of electrically conductive material, if it acts as a counterelectrode. If it is not supposed to act as a counterelectrode, it can consist of electrically insulating material. The ground potential connection 20 can be formed by the carrier 22, if it consists of electrically conductive material.

Figure 5:
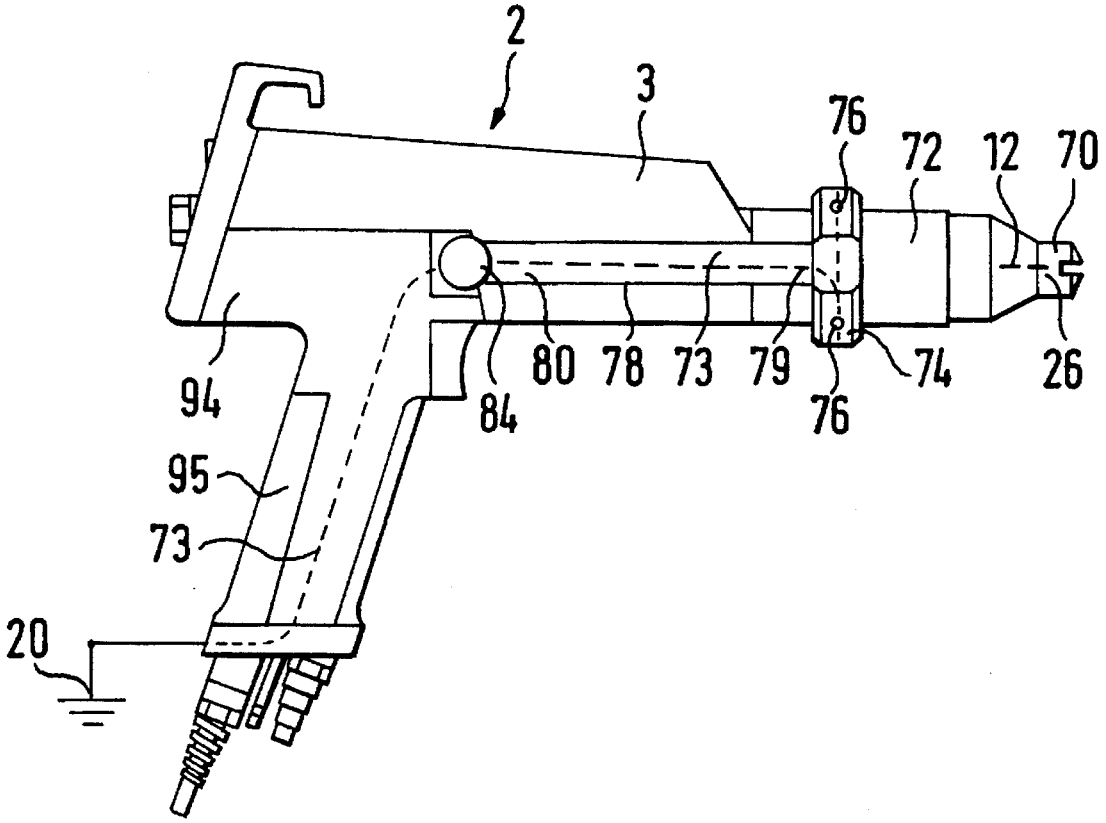
FIG. 5 is a side elevation view of a gun-like electrostatic spray device according to the invention.

FIG. 5 shows a gun-shaped electrostatic spray device 2. Near the upstream end 94 of its spray element 3, the spray element is provided with a handle 95. The upstream end 80 of the connection ridge 78 and the screw 84 are located directly above the handle 95 on the spray element 3. In this way, the electrical ground line 73 can be guided along the handle 95 or through it to the ground potential connection 20. This has the advantage that the material center of gravity of the spray device 2 lies in or in the vicinity of the handle 95, so that it is possible to hold the gun without becoming tired. In FIG. 5, the charging electrode 12 is represented as an axial electrode, while it was assumed in FIG. 3 and 4 that several needle-like charging electrodes 12 are arranged so as to be distributed around the powder path.

In all of the embodiments, the ring-shaped element 74 is preferably adjustable to different axial positions relative to the spray element 3. In all cases, the ring-shaped element 74 is located upstream from the tip 26 of the charging electrode 12, if it acts as a counterelectrode or carries counterelectrodes 76. Obviously, many variations and modifications of the present invention are possible in light of the above teachings. It is therefore to be understood that within the scope of the appended claims, the present invention may be practiced otherwise than as specifically described herein.

I claim:

1. An electrostatic spray device for the electrostatic spray coating of objects, comprising:

a spray gun having an outlet disposed upon a gun axis;

means for discharging coating material from said outlet of said spray gun;

a charging electrode, disposed at a predetermined distance from said outlet of said spray gun, for electrostatically charging said coating material so that said coating material is attracted to an object to be coated;

a counterelectrode disposed at a predetermined distance from said charging electrode and having an electrical potential which is different from that of said charging electrode so as to attract thereto a portion of free ions generated as a result of said electrostatic charging of said coating material; and means adjustably mounting said counterelectrode at different axial positions with respect to said charging electrode.

2. The spray device as set forth in claim 1, further comprising:

means for pneumatically conveying said coating material disposed within said spray gun and fluidically connected to said outlet of said spray gun.

3. The spray device as set forth in claim 1, wherein:

said counterelectrode comprises an annular ring-shaped counterelectrode surrounding a downstream end portion of said spray gun, and disposed upstream of said charging electrode and said spray gun outlet, as considered in the direction of flow of said coating material through said spray gun.

4. The spray device as set forth in claim 1, further comprising:

means for connecting said counterelectrode to ground potential.

5. The spray device as set forth in claim 1, further comprising:

means for discharging compressed air onto said counterelectrode so as to prevent accumulation of said coating material upon said counterelectrode.

6. The spray device as set forth in claim 1, wherein:

said counterelectrode comprises a pair of wire electrodes disposed upon opposite sides of said charging electrode.

7. The spray device as set forth in claim 1, wherein:

said counterelectrode comprises a plurality of counterelectrodes disposed within an annular array about said charging electrode, and wherein said plurality of counterelectrodes are equidistantly spaced from each other along a circumferential path defined within said annular array.

8. The spray device as set forth in claim 1, wherein:

during use, said charging electrode is disposed at a predetermined distance D from an object to be coated; and said predetermined distance defined between said counterelectrode and said charging electrode has a value d which is less than said distance D defined between said charging electrode and an object to be coated such that a proper portion of said free ions are attracted to said counterelectrode and said coating material is properly electrostatically charged.

9. The spray device as set forth in claim 8, wherein:

said distance d is approximately one-third to one-half of said distance D.

10. The spray device as set forth in claim 1, further comprising:

means for generating electrical field lines extending between said charging electrode and an object to be coated and upon which said coating material is disposed as a material cloud;

during use, said charging electrode is disposed at a predetermined distance D from an object to be coated; and said counterelectrode is disposed at a predetermined distance d from an outer surface portion of said material cloud of said coating material disposed upon said electrical field lines which is less than said distance D defined between said charging electrode and an object to be coated such that a proper portion of said free ions are attracted to said counterelectrode and said coating material is properly electrostatically charged.

11. The spray device as set forth in claim 10, wherein:

said distance d is approximately one-third to one-half of said distance D.

12. The spray device as set forth in claim 1, wherein:

said spray-gun comprises a hand-held spray gun.

13. The spray device as set forth in claim 12, further comprising:

a connection ridge having a longitudinal axis disposed parallel to said spray gun axis and having said counterelectrode mounted upon a first end portion thereof while a second end portion of said connection ridge is attached to said spray gun at a predetermined distance from a handle portion of said spray gun.

14. The spray device as set forth in claim 13, wherein:

said connection ridge comprises electrically insulative material; and an electrical transmission line is disposed internally within said connection ridge for providing an electrical connection between a source of ground potential and said counterelectrode.

15. The spray device as set forth in claim 1, further comprising:

bracket means for fixedly attaching said spray gun to a machine robot.

16. The spray device as set forth in claim 15, further comprising:

a connection ridge having a longitudinal axis which is disposed parallel to said spray gun axis and having said counterelectrode mounted upon a first end portion thereof, while a second end portion of said connection ridge is attached to said bracket means.

17. The spray device as set forth in claim 16, wherein:

said connection ridge comprises electrically conductive material so as to form an electrical connection between said bracket means of said robot and said counterelectrode.

18. An electrostatic spray system for the electrostatic spray coating of objects, comprising:

an object to be coated with coating material;

a spray gun having an outlet disposed upon a longitudinal gun axis;

means for discharging coating material from said outlet of said spray gun;

a charging electrode, disposed at a predetermined distance from said outlet of said spray gun, for electrostatically charging said coating material so that said coating material is attracted to said object to be coated;

a counterelectrode disposed at a predetermined distance from said charging electrode and having an electrical potential which is different from that of said charging electrode so as to attract thereto a portion of free ions generated as a result of said electrostatic charging of said coating material; and means adjustably mounting said counterelectrode at different axial positions with respect to said charging electrode.

19. A system as set forth in claim 18, wherein:

said predetermined distance defined between said counterelectrode and said charging electrode comprises a distance value d and is less than a predetermined distance, having a distance value D, defined between said charging electrode and said object to be coated.

20. A system as set forth in claim 18, wherein:

said coating material comprises a material cloud between said outlet of said spray gun and said object to be coated as determined by electrical field lines extending between said charging electrode and said object to be coated; and said counterelectrode is disposed a predetermined distance d, from an outer surface portion of said material cloud, which is less than a predetermined distance D defined between said charging electrode and said object to be coated.

21. A system as set forth in claim 19, wherein:

said distance d is approximately one-third to one-half of said distance D.

22. A system as set forth in claim 20, wherein:

said distance d is approximately one-third to one-half of said distance D.

* * * * *